US008509637B2

(12) United States Patent
Dobbertin et al.

(10) Patent No.: US 8,509,637 B2
(45) Date of Patent: Aug. 13, 2013

(54) METERING APPARATUS FOR ELECTROPHOTOGRAPHIC PRINTER

(75) Inventors: Michael Thomas Dobbertin, Honeoye, NY (US); David James Cornell, Scottsville, NY (US); Henry Paul Mitchell, Jr., Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 275 days.

(21) Appl. No.: 13/115,381

(22) Filed: May 25, 2011

(65) Prior Publication Data

US 2012/0301165 A1 Nov. 29, 2012

(51) Int. Cl.
*G03G 15/08* (2006.01)

(52) U.S. Cl.
USPC ..... 399/53; 399/249; 399/260; 399/264; 399/274; 399/284

(58) Field of Classification Search
USPC ..... 399/53, 249, 260, 264, 273, 274, 399/283, 284
See application file for complete search history.

(56) References Cited

U.S. PATENT DOCUMENTS 4,571,071 A 2/1986 Bothner
4,579,081 A * 4/1986 Kohyama ..... 399/119
4,585,328 A * 4/1986 Moser et al. ..... 118/261
4,624,545 A * 11/1986 Yasuda et al. ..... 399/274
6,385,415 B1 5/2002 Hilbert et al.
6,608,641 B1 8/2003 Alexandrovich et al.
7,502,581 B2 * 3/2009 Jacobs et al. ..... 399/274
7,953,352 B2 * 5/2011 Dobbertin et al. ..... 399/274
2002/0168200 A1 11/2002 Stelter et al.
2006/0133870 A1 6/2006 Ng
2008/0273900 A1 11/2008 Dobbertin et al.

FOREIGN PATENT DOCUMENTS

JP 08185045 A * 7/1996

* cited by examiner

*Primary Examiner* — David Gray
*Assistant Examiner* — Francis Gray
(74) *Attorney, Agent, or Firm* — Christopher J. White

(57) ABSTRACT

A metering skive for a dry electrophotographic (EP) printer is mounted on a retractable skive mount. The skive mount is spring-loaded to a mounting block, and a stop pin sets the distance between the skive mount and the mounting block. A movable spacer with a plurality of laterally-separated regions of respective, different thicknesses is mounted between the head of the stop pin and the mounting block. A retractor can be operated to pull the skive mount towards the mounting block so the spacer can be moved to select a desired spacing between the mounting block and the skive mount, and thus a desired gap between the metering skive and the toning member in the printer.

5 Claims, 5 Drawing Sheets

METERING APPARATUS FOR ELECTROPHOTOGRAPHIC PRINTER

FIELD OF THE INVENTION

This invention pertains to the field of printing and more particularly to adjusting toner flow in a printer.

BACKGROUND OF THE INVENTION

Electrophotographic printers are useful for producing high-quality printed images of a wide range of types. These printers electrostatically deposit dry toner particles on a receiver using an image-wise charged photoconductor, and then fuse those particles with heat or pressure to the receiver to form a fused print image. To accommodate various print speeds, the flow of toner particles from a toning member to the photoconductor is adjusted. A toning member can be a toning roller or belt. For example, commonly-assigned, co-pending U.S. Patent Publication No. 20080273900 by Dobbertin et al., the disclosure of which is incorporated herein by reference, describes a metering skive for establishing a developer material metering gap and a mechanism for selectively moving the metering skive to an operative position relative to the toning member.

SUMMARY OF THE INVENTION

Some printers use manual adjustment of the developer material metering gap. An operator adjusts the gap according to the desired print speed or other job parameters. However, any deviation of the metering skive gap from a desired gap can affect image quality. Consequently, there is an ongoing need for a printer with a repeatably-adjustable metering-skive gap. Moreover, present manual adjustments required skilled service technicians and can take up to ten minutes per station (e.g., 50 minutes for a five-station printer). There is thus also a need for a way of permitting less-skilled operators to adjust the skive gap in a shorter period of time, to provide increased printer uptime and lower operating costs.

According to an aspect of the present invention, there is provided metering apparatus for a dry electrophotographic (EP) printer, comprising:

a) the dry EP printer including a mounting block and a rotatable toning member arranged in proximity to the mounting block and adapted to move developer containing toner around its surface;

b) a skive mount arranged between the mounting block and the toning member;

c) a metering skive attached to the skive mount and arranged to deflect developer being moved on the toning member and more than a selected distance from the surface thereof;

d) a stop pin for holding the skive mount to the mounting block;

e) a spring adapted to force the skive mount away from the mounting block;

f) a movable spacer arranged between the head of the stop pin and the mounting block, the movable spacer having a plurality of laterally-separated regions, each region having a respective thickness;

g) a retractor operative in a first position to pull the skive mount towards the mounting block, and operative in a second position to release the skive mount so that the spring moves the skive mount until the stop pin contacts the spacer and the spacer contacts the mounting block, and the stop pin is axially loaded; and h) a control member for moving the spacer to arrange a selected region between the head of the stop pin and the mounting block while the retractor is in the first position, whereby when the retractor is operated in the second position, the skive mount and metering skive move to provide a distance between the skive mount and the surface of the toning member corresponding to the thickness of the selected region.

An advantage of this invention is that it provides repeatable adjustment of the position of a metering skive in a printer. This permits skive gap to be adjusted without requiring expensive, high-precision actuators. Various embodiments permit the skive gap to be adjusted without removing a printing module from the printer, which can permit gap changes in 30 seconds instead of 5-10 minutes. The skive gap can be adjusted by an operator rather than a trained technician, so the cost of the technician's travel to the printer is removed. The customer has more flexibility in running jobs. The customer can adjust the metering skive themselves at any time to print jobs at different speeds without having to schedule or wait for a technician to come to the site.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
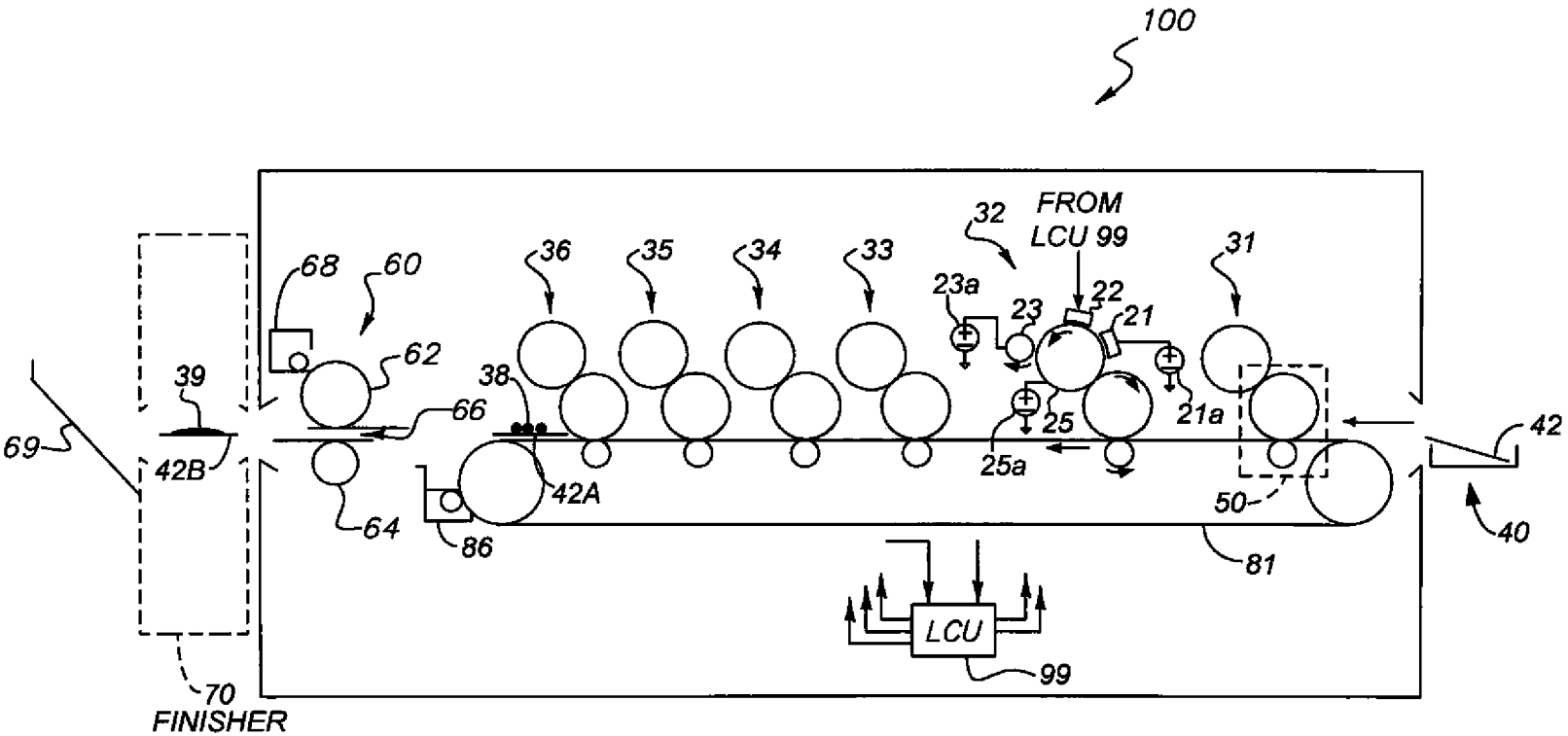
FIG. 1 is an elevational cross-section of an electrophotographic reproduction apparatus suitable for use with various embodiments.

The attached drawings are for purposes of illustration and are not necessarily to scale.

DETAILED DESCRIPTION OF THE INVENTION

The electrophotographic (EP) printing process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 3000SE printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. As used herein, clear toner is considered to be a color of toner, as are C, M, Y, K, and Lk, but the term "colored toner" excludes clear toners. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective toners are deposited one upon the other at respective locations on the receiver and the height of a respective toner stack is the sum of the toner heights of each respective color. Uniform stack height provides the print with a more even or uniform gloss.

FIG. 1 is an elevational cross-section showing portions of a typical electrophotographic printer 100 useful with various embodiments. Printer 100 is adapted to produce print images, such as single-color (monochrome), CMYK, or hexachrome (six-color) images, on a receiver (multicolor images are also known as "multi-component" images). Images can include text, graphics, photos, and other types of visual content. One embodiment involves printing using an electrophotographic print engine having six sets of single-color image-producing or -printing stations or modules arranged in tandem, but more or fewer than six colors can be combined to form a print image on a given receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, 36, also known as electrophotographic imaging subsystems. Each printing module 31, 32, 33, 34, 35, 36, produces a single-color toner image for transfer using a respective transfer subsystem 50 (for clarity, only one is labeled) to a receiver 42 successively moved through the printing modules 31, 32, 33, 34, 35, 36. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each printing module 31, 32, 33, 34, 35, 36 includes various components. For clarity, these are only shown in printing module 32. Around photoreceptor 25 are arranged, ordered by the direction of rotation of photoreceptor 25, charger 21, exposure subsystem 22, and toning member 23.

In the EP process, an electrostatic latent image is formed on photoreceptor 25 by uniformly charging photoreceptor 25 and then discharging selected areas of the uniform charge to yield an electrostatic charge pattern corresponding to the desired image (a "latent image"). Charger 21 produces a uniform electrostatic charge on photoreceptor 25 or its surface. Exposure subsystem 22 selectively image-wise discharges photoreceptor 25 to produce a latent image. Exposure subsystem 22 can include a laser and raster optical scanner (ROS), one or more LEDs, or a linear LED array.

After the latent image is formed, charged toner particles are brought into the vicinity of photoreceptor 25 by toning member 23 and are attracted to the latent image to develop the latent image into a visible image. Note that the visible image may not be visible to the naked eye depending on the composition of the toner particles (e.g. clear toner). Toning member 23 can also be referred to as a development roller. Toning member 23 can be part of a toning station, also referred to as a development station. Toner can be applied to either the charged or discharged parts of the latent image.

After the latent image is developed into a visible image on photoreceptor 25, a suitable receiver 42 is brought into juxtaposition with the visible image. In transfer subsystem 50, a suitable electric field is applied to transfer the toner particles of the visible image to receiver 42 to form the desired print image 38 on the receiver, as shown on receiver 42A. The imaging process is typically repeated many times with reusable photoreceptors 25.

Receiver 42A is then removed from its operative association with photoreceptor 25 and subjected to heat or pressure to permanently fix ("fuse") print image 38 to receiver 42A. Plural print images, e.g. of separations of different colors, are overlaid on one receiver before fusing to form a multi-color print image 38 on receiver 42A.

Each receiver 42, during a single pass through the six printing modules 31, 32, 33, 34, 35, 36, can have transferred in registration thereto up to six single-color toner images to form a pentachrome image. As used herein, the term "hexachrome" implies that in a print image 38, combinations of various of the six colors are combined to form other colors on receiver 42 at various locations on receiver 42. That is, each of the six colors of toner can be combined with toner of one or more of the other colors at a particular location on receiver 42 to form a color different than the colors of the toners combined at that location. In an embodiment, printing module 31 forms black (K) print images, 32 forms yellow (Y) print images, 33 forms magenta (M) print images, 34 forms cyan (C) print images, 35 forms light-black (Lk) images, and 36 forms clear images.

In various embodiments, printing module 36 forms print image 38 using a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 36. Print image 38 on receiver 42A includes unfused toner particles.

Subsequent to transfer of the respective print images, overlaid in registration, one from each of the respective printing modules 31, 32, 33, 34, 35, 36, receiver 42A is advanced to a fuser 60, i.e. a fusing or fixing assembly, to fuse print image 38 to receiver 42A. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver 42.

The receivers (e.g., receiver 42B) carrying the fused image (e.g., fused image 39) are transported in a series from the fuser 60 along a path either to a remote output tray 69, or back to printing modules 31, 32, 33, 34, 35, 36 to create an image on the backside of the receiver (e.g., receiver 42B), i.e. to form a duplex print. Receivers (e.g., receiver 42B) can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various media-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers 42. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Various parameters of the components of a printing module (e.g., printing module 31) can be selected to control the operation of printer 100. In an embodiment, charger 21 is a corona charger including a grid between the corona wires (not shown) and photoreceptor 25. Voltage source 21*a* applies a voltage to the grid to control charging of photoreceptor 25. In an embodiment, a voltage bias is applied to toning member 23 by voltage source 23*a* to control the electric field, and thus the rate of toner transfer, from toning member 23 to photoreceptor 25. In an embodiment, a voltage is applied to a conductive base layer of photoreceptor 25 by voltage source 25*a* before development, that is, before toner is applied to photoreceptor 25 by toning member 23. The applied voltage can be zero; the base layer can be grounded. This also provides control over the rate of toner deposition during development. In an embodiment, the exposure applied by exposure subsystem 22 to photoreceptor 25 is controlled by LCU 99 to produce a latent image corresponding to the desired print image. All of these parameters can be changed, as described below.

Further details regarding printer 100 are provided in U.S. Pat. No. 6,608,641, issued on Aug. 19, 2003, to Peter S. Alexandrovich et al., and in U.S. Publication No. 20060133870, published on Jun. 22, 2006, by Yee S. Ng et al., the disclosures of which are incorporated herein by reference.

Figure 2A:
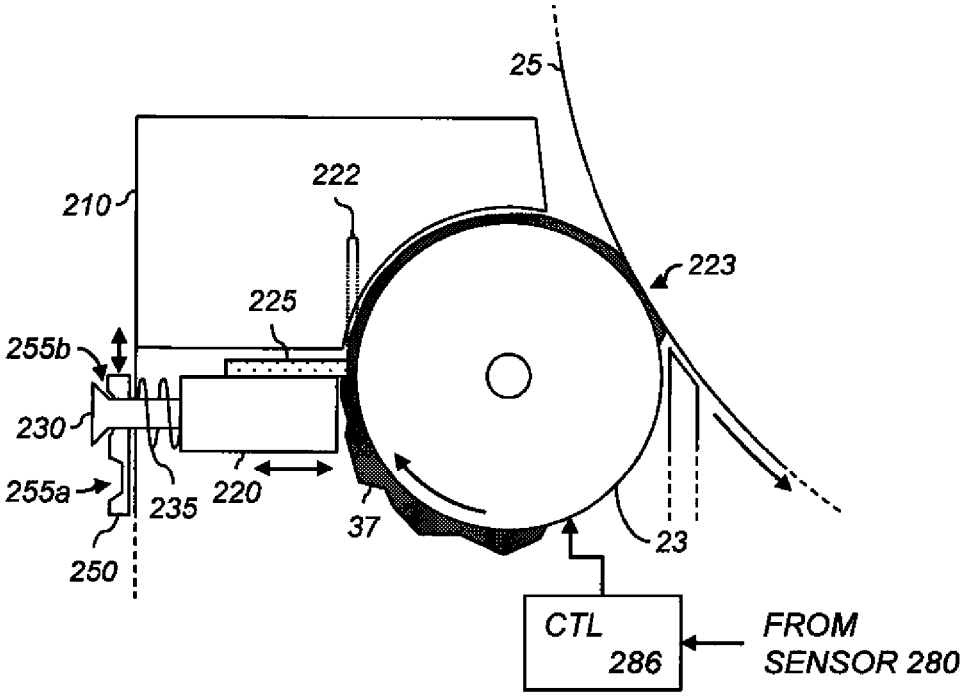
FIG. 2A shows a cross-sectional side elevation, and FIG. 2B a front elevation, of metering apparatus for a dry electrophotographic (EP) printer according to various embodiments.
Figure 2B:
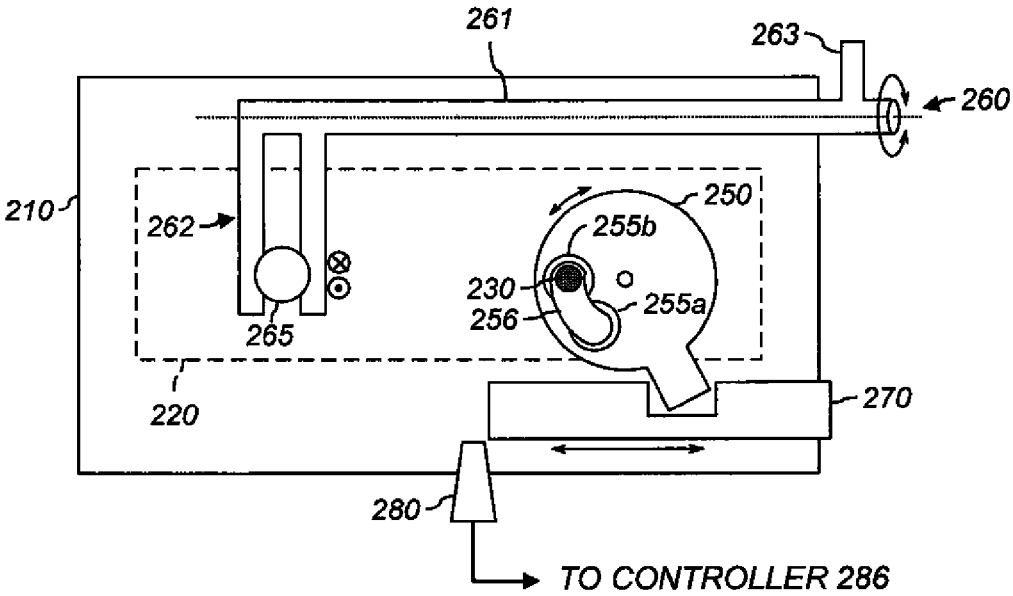

FIG. 2A shows a cross-sectional side elevation, and FIG. 2B a front elevation, of metering apparatus for a dry electrophotographic (EP) printer according to various embodiments. Printer 100 (FIG. 1) includes mounting block 210 that holds the components of the printer. Rotatable toning member 23, which can also be a hollow toning shell, is arranged in proximity to mounting block 210 and adapted to move developer 37 around its surface. Developer 37 includes toner particles, and can include magnetic carrier particles or other particles. Mounting block 210 can include washers, spacers, or other elements that vary the thickness of mounting block 210. Mounting block 210 can also include one or more mounting plates.

Skive mount 220 is arranged between mounting block 210 and toning member 23. Skive mount 220 is movable closer to toning member 23 and farther from mounting block 210, or vice versa. Metering skive 225 is attached to skive mount 220. Metering skive 225 is arranged to deflect developer 37 being moved on toning member 23 and more than a selected distance 222 from the surface of toning member 23. As shown, the irregular mass of developer 37 carried by toning member 23 is leveled by metering skive 225 to form a nap on toning member 23 that is of substantially consistent thickness (height) until reaching toning zone 223, where developer 37 is brought into contact with photoreceptor 25. The example shown here is for a two-component developer using a magnetic brush to urge developer 37 towards photoreceptor 25; various embodiments can also be used with single-component developers.

In various embodiments, distance 222 is 42-49 mils, and the spacing between photoreceptor 25 and the surface of toning member 23 at their closest point of approach in toning zone 223 is 13-20 mils. As a result, developer 37 is compressed in toning zone 223. If developer 37 is compressed beyond the compression limit determined by the mechanical properties and composition of the developer, the developer will form sheets that exit toning zone 223. This undesirable phenomenon is referred to as "plop-out." To avoid plop-out, the amount of developer 37 entering toning zone 223 is correlated to the speeds of rotation of toning member 23 and photoreceptor 25. In one example, a printer can operate at a slow speed and a fast speed. The fast speed uses a higher angular velocity for photoreceptor 25. Since developer 37 is being removed from toning zone 223 at a higher rate in the fast speed than in the slow speed, more developer 37 can be provided to toning zone 223 per unit time in the fast speed than in the slow speed. As a result, distance 222 can be larger in the fast speed than in the slow speed.

Stop pin 230 holds skive mount 220 to mounting block 210. Stop pin 230 has a head (e.g., flat, beveled, or countersunk), and can include washers (e.g., flat or countersunk washers) or other parts so that stop pin 230 mechanically contacts spacer 250 during normal operation, as described below. Spring 235 provides force on skive mount 220 away from mounting block 210. In normal operation, therefore, stop pin 230 determines the position of skive mount 220, and thus metering skive 225, with respect to toning member 23. Stop pin 230 and any associated washers or other parts are adapted to provide repeatable positioning of metering skive 225 with respect to toning member 23.

Retractor 260 is operative in a first position to pull skive mount 220 towards mounting block 210 through puller pins or other parts, as described below. In an embodiment, retractor 260 includes rotatable axle 261 from which protrude one or more fingers 262. Finger(s) 262 engage puller pin 265 so that when axle 261 rotates with its top going into the page, fingers 262 lift puller pin 265 out of the plane of the page towards the viewer against the force provided to skive mount 220 by spring 235. Puller pin 265 is attached to skive mount 220 and pulls skive mount 220 towards mounting block 210. Specifically, puller pin 265 is arranged so that retractor 260 exerts force on puller pin 265 in the first position of retractor 260 to pull skive mount 220 towards mounting block 210. In various embodiments, retractor 260 includes handle 263 that can be pushed into the page by an operator to cause retractor 260 to rotate and lift puller pin 265. In an embodiment, puller pin 265 has a beveled head or can be countersunk into finger (s) 262.

In order to repeatably control distance 222, movable spacer 250 is arranged between a feature on stop pin 230, e.g., the head or shoulder of stop pin 230, or an E-ring that snaps into a groove on stop pin 230, and mounting block 210. Spacer 250 can include rigid washers adjacent to stop pin 230 or mounting block 210. Movable spacer 250 has a plurality of laterally-separated regions 255*a*, 255*b*, each region having a respective thickness. Retractor 260 is operative in a second position to release skive mount 220 so that spring 235 moves skive mount 220 until stop pin 230 contacts spacer 250, which itself contacts mounting block 210. When retractor 260 is in the second position, stop pin 230 is axially loaded, and spring 235 holds skive mount 220 a distance from mounting block 210 determined by which region 255*a*, 255*b* of spacer 250 stop pin 230 is seated in.

Control member 270 moves spacer 250 (translationally or rotationally) to arrange a selected region 255*a*, 255*b* between the head of stop pin 230 and mounting block 210 while retractor 260 is in the first position. Channel 256 in spacer 250 permits spacer 250 to rotate under stop pin 230 while skive mount 220 is held towards mounting block 210, and therefore stop pin 230 is raised off spacer 250. When retractor 260 is operated in (returned to) the second position, skive mount 220 and metering skive 225 move to provide a distance 222 between skive mount 220 and the surface of toning member 23 corresponding to the thickness of the selected region 255*a*, 255*b*.

In the example shown here, spacer 250 is thicker in region 255*b* than in region 255*a*. Consequently, region 255*b* is used when larger distance 222 is desired, e.g., for printing at a higher speed (more inches of receiver per second), and region 255*a* is used when printing at a lower speed. Developer mass flow rate increases as distance 222 increases. Using region 255*b* for higher-speed printing provides increased flow rate to provide complete development and provide images with the desired $D_{max}$ (highest print density). Using region 255*a* for lower-speed printing reduces the probability of high-frequency banding or plop-out, as discussed above. Moreover, adjusting metering skive 225 for lower-speed printing, rather than reducing the rotational speed of toning member 23, maintains development efficiency at desired levels without providing too great a mass of developer per unit time into toning zone 223.

In various embodiments, sensor 280 detects the selected region of spacer 250. Sensor 280 can include a proximity sensor (optical, capacitive, or magnetic), an optointerruptor, or a mechanical switch. Sensor 280 can monitor spacer 250, control member 270, or other mechanical components with positions correlated to the selected region of spacer 250. In the example shown here, sensor 280 is a proximity sensor that detects whether control member 270 is adjacent to sensor 280 (region 255*a*) or not (region 255*b*).

In various embodiments, controller 286 is responsive to sensor 280. Controller 286 can include a CPU or MPU running a stored program, or an FPGA, ASIC, PLD, PLA, or PAL running determined logic. Controller 286 causes photoreceptor 25 or toning member 23 to rotate at a speed corresponding to the sensed selected region of spacer 250. In an example, when printing at 120 A4 impressions per minute, distance 222 is set to 49 mils and photoreceptor 25 (182 mm diameter≈571.77 mm circumference) is rotated at 514 mm/s (circumferential velocity; ≈53.94 rpm). When printing at 83 or 100 A4 impressions per minute, distance 222 is set to 42 mils and photoreceptor 25 is rotated at 356 mm/s (≈37.36 rpm) for 83 impressions/min or 429 mm/s (≈45.02 rpm) for 100 impressions/min.

In some embodiments, the printer stores a selection for the speed of photoreceptor 25 or toning member 23. Controller 286 includes a memory storing information about which region of spacer 250 is appropriate for one or more of the speed selections. Before a job is printed, controller 286 compares the sensed selected region of spacer 250 to the stored selection of speed and reports an error to the operator if the two do not correspond to a valid combination stored in the memory. In various embodiments, controller 286 adjusts settings for other components of the printer, or checks such settings for consistency, with respect to the sensed selected region of spacer 250.

Specifically, various embodiments include a memory containing information about which region of the spacer 250 is appropriate for one or more print speeds. Controller 286 is responsive to the sensor and the memory for receiving a selected print speed, comparing the sensed selected region of the spacer 250 to the stored region corresponding to the selected print speed, and reporting an error if the sensed selected region is not the stored region corresponding to the selected print speed.

In various embodiments, toning member 23 can be part of a toning station including a housing forming, at least in part, a reservoir for developer material. Toning member 23 delivers developer material to dielectric support member, e.g., photoreceptor 25, in toning zone 223. Toning member 23 can include a core magnet inside a shell, the core magnet and the shell having relative rotation. A transport mechanism can transport developer material from the reservoir to toning member 23.

In various embodiments, metering skive 225 establishes a developer material metering gap (distance 222) between the metering skive and toning member 23 for controlling the quantity of developer material transported from the reservoir portion of the housing to toning member 23, and then through toning zone 223 to develop a latent image charge pattern on photoreceptor 25. In various embodiments, metering skive 225 is positioned parallel to the longitudinal axis of toning member 23 at a location upstream in the direction of rotation of toning member 23 prior to toning zone 223. Further information about two-component development is provided in commonly-assigned U.S. Patent Publication No. 20020168200 by Stelter et al., the disclosure of which is incorporated herein by reference.

Figure 3:
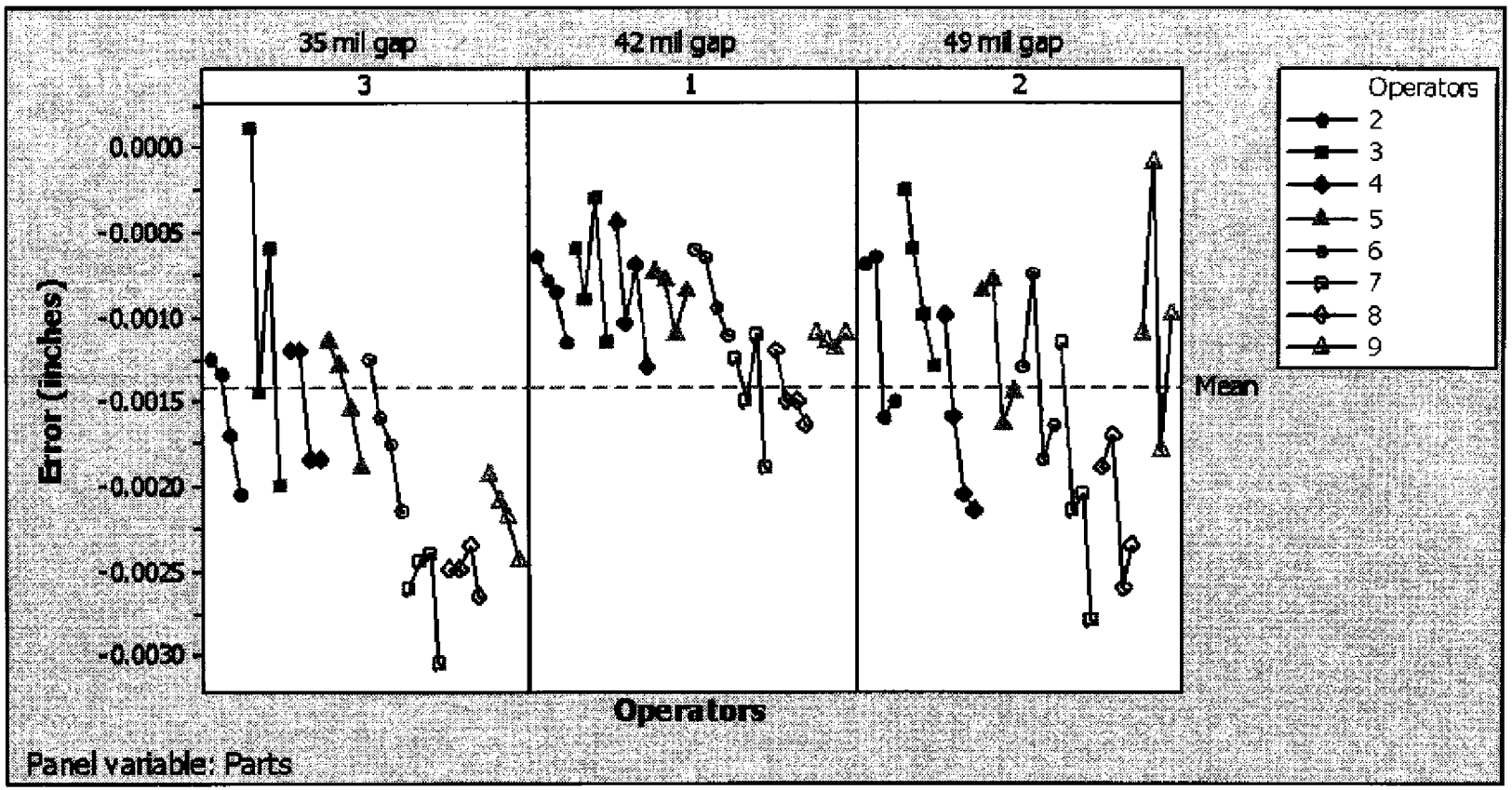
FIG. 3 is a graph of skive-position repeatability set by operators using pin gauges.

FIG. 3 is a graph of skive-position repeatability set by operators using pin gauges on a printer without spacer 250 and related components as described herein. In this test, eight operators were asked to adjust the metering skive gap to each of three setpoints. Each operator was given a pin gauge for each setting. (A pin gauge is a cylinder with diameter equal to the desired setpoint, within a tight tolerance.) After the operator adjusted the metering skive gap, the gap was measured using a linear variable distance transformer (LVDT) distance sensor. FIG. 3 shows the resulting data. The ordinate is the error in mils (0.001") by which the measured distance deviates from the desired setpoint. The left-hand group of points is for a setpoint of 35 mils, the middle group for 42 mils, and the right-hand group for 49 mils. Each trace connects the points for multiple attempts by the same operator to set the position. FIG. 3 shows a lack of precision and of accuracy in establishing positions. The standard deviation of error was 0.7 mils, for a 6σ (±3σ) range of ±2.1 mils.

Figure 4:
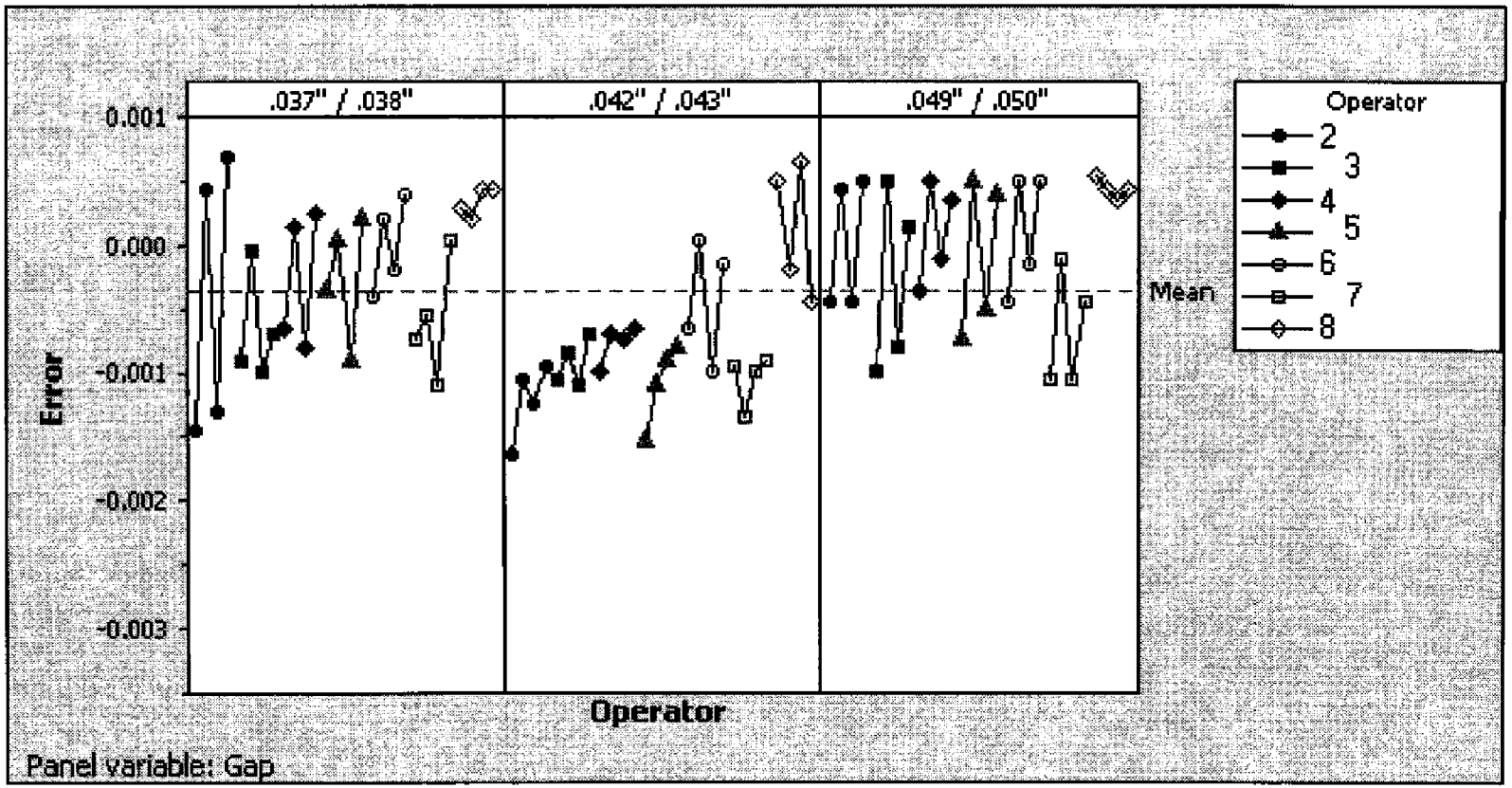
FIG. 4 is a graph of skive-position repeatability set by operators using go/no-go gauges.

FIG. 4 is a graph of skive-position repeatability set by operators using go/no-go gauges. The procedure and axes are as in FIG. 3. However, rather than a pin gauge, each operator was given a go/no-go gauge for each setpoint. In the left-hand group, the gauge (within its own tolerances) would assist the operator in rejecting any gap not in the range [37, 38] mils. The middle group gauge rejects outside of [42, 43] mils, and the right-hand group gauge rejects outside of [49, 50] mils. As shown, accuracy was better in FIG. 4 than in FIG. 3. However, precision was comparable: the standard deviation of error was 0.68 mils, for a 6σ (±3σ) range of ±2.04 mils.

Figure 5:
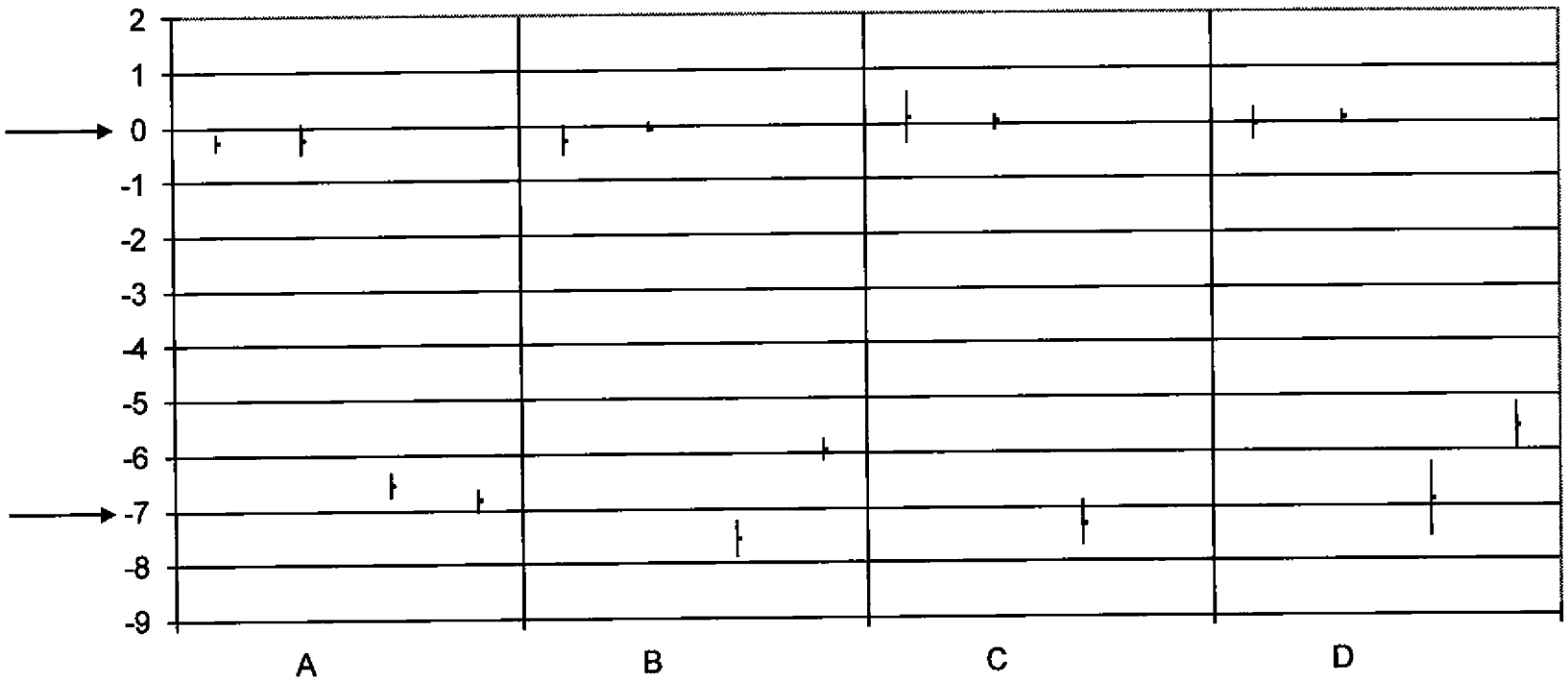
FIG. 5 is a graph of skive-position repeatability measured on apparatus constructed according to various embodiments.

FIG. 5 is a graph of skive-position repeatability measured on several toning stations constructed according to various embodiments. Groups "A", "B", "C", and "D" refer to four stations tested. To collect these data, an operator retracted skive mount 220 (FIG. 2A) using retractor 260 (FIG. 2B) and operated control member 270 (FIG. 2B) to place spacer 250 (FIG. 2B) in position for the desired gap. The operator then released retractor 260. The resulting gap (distance 222, FIG. 2A) was measured using an LVDT sensor. This was performed multiple times for two setpoints: 49 mils and 42 mils. The ordinate on FIG. 5 shows difference between measured data and 49 mils. Therefore, the target for the 49 mil tests is 0 on the ordinate, and the target for the 42 mil tests is −7 on the ordinate. These targets are marked with arrows. In each group, summaries of two datasets are shown for each setpoint. Each skive mount 220 was equipped with two stop pins 230 at different cross-track positions. Each dataset summarized here was measured at one of the two stop pins 230. The horizontal tick mark shows the mean of the measured data, and the vertical bars show the extent of the 6σ (±3σ) range. As shown, in the cases tested, the 6σ range was less than ±2 mils. In at least ¾ of the cases tested, the 6σ range was less than ±1 mil. This is more precise than the performance of operators with either pin gauges or go/no-go gauges, and does not require skilled operators to perform the adjustment. Accuracy is also quite good; the grand average of the means of the measured error is −0.08 mils off target for the 49 mil setpoint and 0.27 mils off target (−6.73 mils on the ordinate) for the 42 mil setpoint.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

21 charger
21*a* voltage source
22 exposure subsystem
23 toning member
23*a* voltage source
25 photoreceptor
25*a* voltage source
31, 32, 33, 34, 35, 36 printing module
37 developer
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
210 mounting block
220 skive mount
222 distance
223 toning zone
225 metering skive
230 stop pin
235 spring
250 spacer
255*a*, 255*b* region
256 channel
260 retractor
261 axle
262 fingers
263 handle
265 puller pin
270 control member
280 sensor
286 controller

The invention claimed is:

1. Metering apparatus for a dry electrophotographic (EP) printer, comprising:

a) the dry EP printer including a mounting block and a rotatable toning member arranged in proximity to the mounting block and adapted to move developer containing toner around its surface;

b) a skive mount arranged between the mounting block and the toning member;

c) a metering skive attached to the skive mount and arranged to deflect developer being moved on the toning member and more than a selected distance from the surface thereof;

d) a stop pin for holding the skive mount to the mounting block;

e) a spring adapted to force the skive mount away from the mounting block;

f) a movable spacer arranged between the head of the stop pin and the mounting block, the movable spacer having a plurality of laterally-separated regions, each region having a respective thickness;

g) a retractor operative in a first position to pull the skive mount towards the mounting block, and operative in a second position to release the skive mount so that the spring moves the skive mount until the stop pin contacts the spacer and the spacer contacts the mounting block, and the stop pin is axially loaded; and h) a control member for moving the spacer to arrange a selected region between the head of the stop pin and the mounting block while the retractor is in the first position, whereby when the retractor is operated in the second position, the skive mount and metering skive move to provide a distance between the skive mount and the surface of the toning member corresponding to the thickness of the selected region.

2. The apparatus according to claim 1, further including a puller pin attached to the skive mount and arranged so that the retractor exerts force on the puller pin in the first position to pull the skive mount towards the mounting block.

3. The apparatus according to claim 1, further including a sensor for detecting the selected region of the spacer.

4. The apparatus according to claim 3, further including a controller responsive to the sensor for causing the toning member to rotate at a speed corresponding to the sensed selected region.

5. The apparatus according to claim 3, further including:

i) a memory containing information about which region of the spacer is appropriate for one or more print speeds; and j) a controller responsive to the sensor and the memory for receiving a selected print speed, comparing the sensed selected region of the spacer to the stored region corresponding to the selected print speed, and reporting an error if the sensed selected region is not the stored region corresponding to the selected print speed.

* * * * *